US008550856B2

(12) United States Patent
Lin

(10) Patent No.: US 8,550,856 B2
(45) Date of Patent: Oct. 8, 2013

(54) TRANSFER PLUG ASSEMBLY

(76) Inventor: Po-Hsun Lin, Taipei (TW)

( * ) Notice: Subject to any disclaimer, the term of this patent is extended or adjusted under 35 U.S.C. 154(b) by 0 days.

(21) Appl. No.: 13/311,558

(22) Filed: Dec. 6, 2011

(65) Prior Publication Data

US 2013/0143431 A1 Jun. 6, 2013

(51) Int. Cl.
*H01R 13/62* (2006.01)

(52) U.S. Cl.
USPC ..... 439/638

(58) Field of Classification Search
USPC ..... 439/638, 640
See application file for complete search history.

(56) References Cited

U.S. PATENT DOCUMENTS 6,213,782 B1 * 4/2001 Derstine ..... 439/31
6,464,519 B1 * 10/2002 Hawks ..... 439/172
7,255,567 B1 * 8/2007 Liao ..... 439/11
7,416,413 B2 * 8/2008 Liao ..... 439/11
7,473,141 B2 * 1/2009 Liao ..... 439/638
7,607,950 B2 * 10/2009 Liao ..... 439/638
7,670,190 B2 * 3/2010 Shi et al. ..... 439/640
8,298,003 B2 * 10/2012 Wu ..... 439/501
2006/0046575 A1 * 3/2006 Allen ..... 439/638
2006/0073717 A1 * 4/2006 Ng et al. ..... 439/131
2009/0298325 A1 * 12/2009 Jonker et al. ..... 439/501

* cited by examiner

*Primary Examiner* — Gary F. Paumen

(57) ABSTRACT

A transfer plug assembly includes a first plug, first flexible link, second flexible link, and a second plug. A first end of each the first flexible link and the second flexible link are connected to two lateral sides of the first plug respectively. A second end of each the first flexible link and the second flexible link are connected to two lateral sides of the second plug respectively. The second plug serves to connect the first plug. Through the linking of the first and second flexible links, the second plug will hang around the first plug and is accessible nearby. The flexible linking of the first and second links will provide free movability between the first plug and the second plug.

3 Claims, 8 Drawing Sheets

TRANSFER PLUG ASSEMBLY

FIELD OF THE INVENTION

The present invention relates to transfer plugs, and particular to a transfer plug assembly having at least two transfer plugs.

DESCRIPTION OF THE PRIOR ART

Information technology nowadays is well developed and related products are extremely popular. Information or digital data is frequently transmitted between electronic devices. Such transmission is performed through a transmission cable or transiting plug, or sometimes both. Power supply could also be done through the connection. However, different sockets and specifications of the transmission cable or plug between various makers and brands is hard to integrate or unite.

For example, a user want to transmit data from a device A (a camera of A brand with A socket) to a device B (a personal computer of B brand with B socket). However, the plug of a transmission cable of the device A can not be applied to the port of the device B. Therefore, a transmitting plug fitting the plug of the transmission cable and the port will be needed for the transmission. Similarly, another transiting plug for a C device (a personal computer of C brand with C socket) is needed. For transmitting data, a lot of transiting plugs must be prepared. However, the store of those plugs and time to find them are very annoying.

Accordingly, a US published U.S. Pat. No. 7,473,141 B2 and Taiwan invention patent I307193 disclose a transiting plug including a insulating shell having two arms, first pivoting portion, and a first and second connectors. The first and the second connector are electrically connected to each other within the insulating shell. A signal plug is movably connected to the insulating shell. A third connector serving to connect the second connector is formed to an front end of the signal plug. The signal plug has a guiding groove corresponding to the first pivoting portion in a lateral side thereof.

The two arms of the insulating shell of the prior art have a first pivoting portion respectively to engage the guiding groove of the signal plug. When the signal plug is not needed, the signal plug can be slide through the arms away from the second connector and sway aside without removing. However, the movable linking of the insulating shell and the signal plug still have some limit in certain spaces or applications.

SUMMARY OF THE PRESENT INVENTION

Accordingly, the primary object of the present invention is to provide a transfer plug assembly including a first plug and a second plug. A first end of each a first flexible link and a second flexible link are connected to two lateral sides of the first plug respectively. A second end of each the first flexible link and the second flexible link are connected to two lateral sides of the second plug respectively.

Through the linking of the first and second flexible links, the second plug will hang around the first plug and is accessible nearby. The flexible linking of the first and second links will provide freely movability between the first plug and the second plug.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
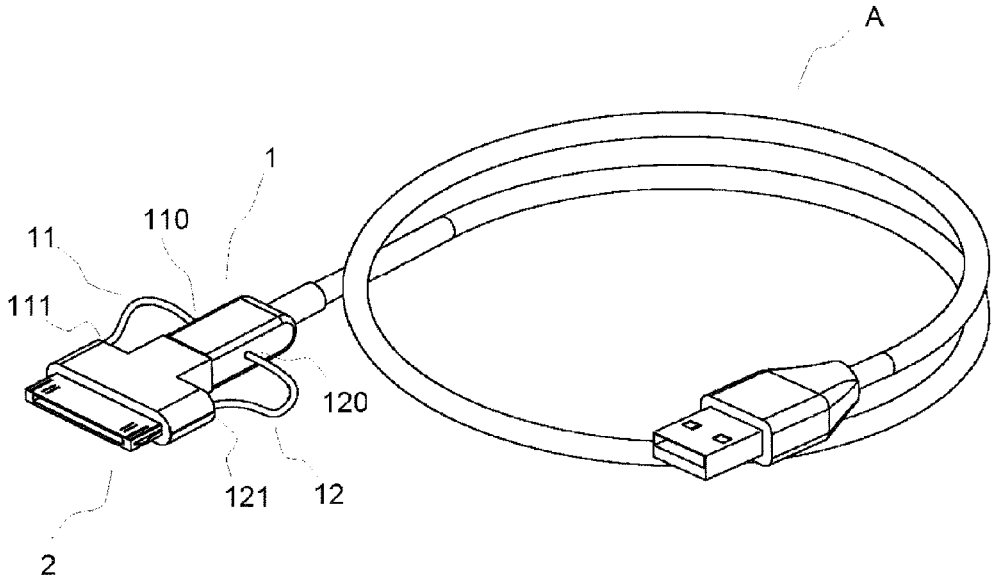
FIG. 1 is a schematic view showing the connection of a first plug and a second plug with a transmission cable of the present invention.
Figure 2:
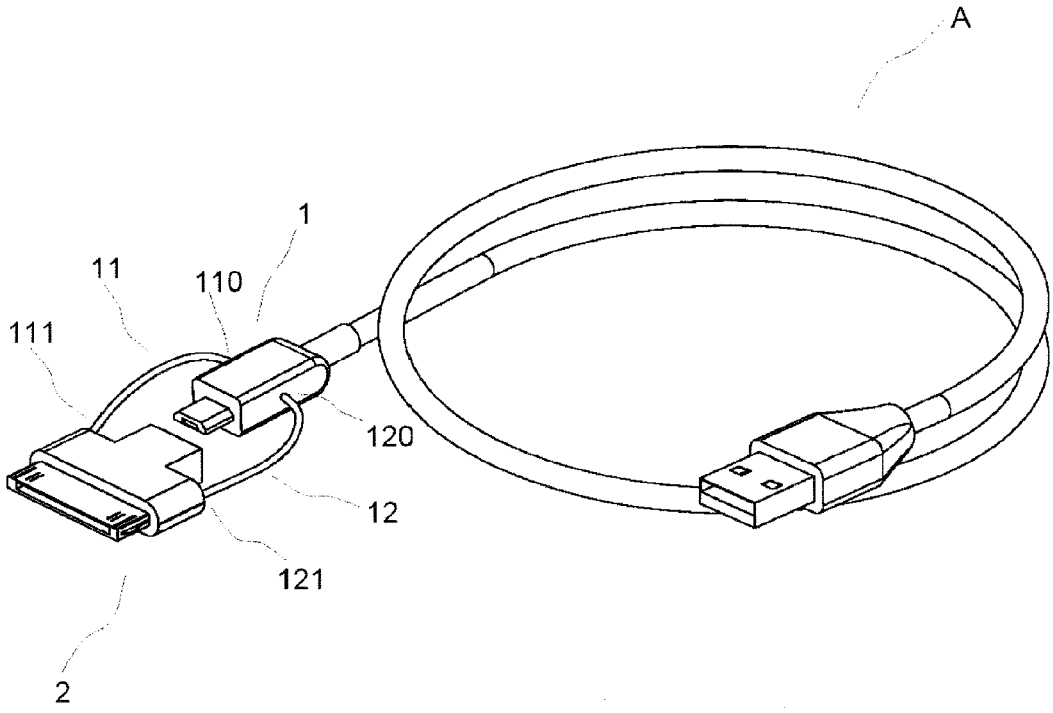
FIG. 2 is a schematic view showing the separation of the first plug and the second plug of the present invention.

Referring to FIGS. 1 and 2, a preferable embodiment of a transfer plug assembly according to the present invention includes a first plug 1. A transmission cable A is connected to the first plug 1 but not to confine the scope of the invention. Two lateral sides of the first plug 1 are connected by first ends 110 and 120 of a first flexible link 11 and a second flexible link 12 respectively. Second ends 111 and 121 of the first flexible link 11 and second flexible link 12 are connected to two lateral sides of a second plug 2 respectively.

Through the linking of the first and second flexible links 11 and 12, the second plug 2 will hang around the first plug 1 and is accessible for being connected to the first plug 1. The second plug 2 nearby can be connected to the first plug 1 when needed so as to spare the effort for searching. The flexible linking of the first and second links 11 and 12 will provide free movability for any circumstance.

Figure 3:
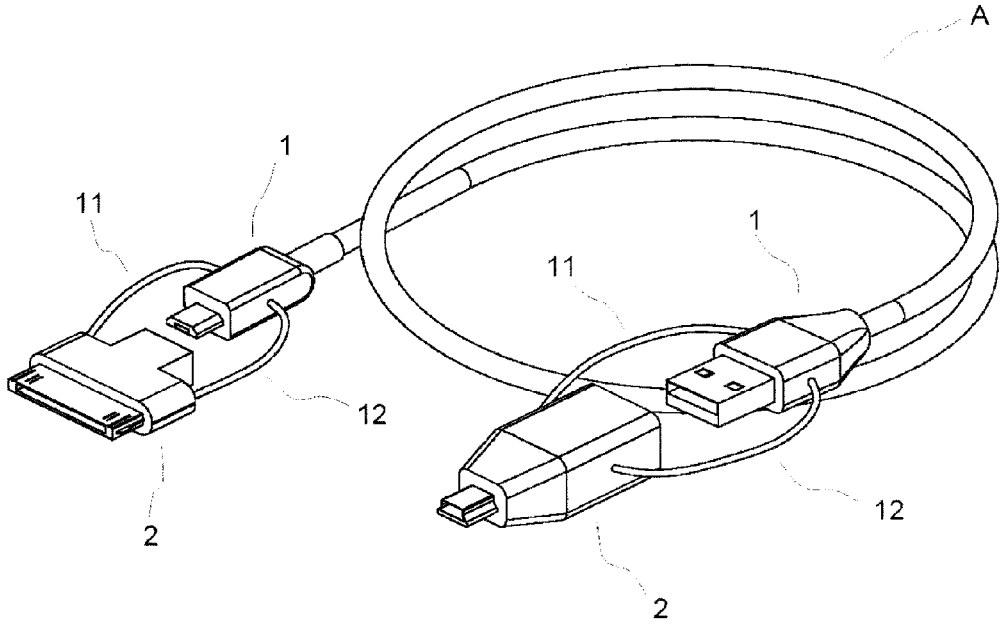
FIG. 3 is a schematic view showing two first plugs on both ends of a transmission cable of the present invention.

Referring to FIG. 3, both ends of the transmission cable A have a first plug 1, and a second plug 2 linked by the first flexible link 11 and the second flexible link 12 is arranged to both the first plugs 1. The plugs 1 and plugs 2 have different sockets in the embodiment.

Figure 4:
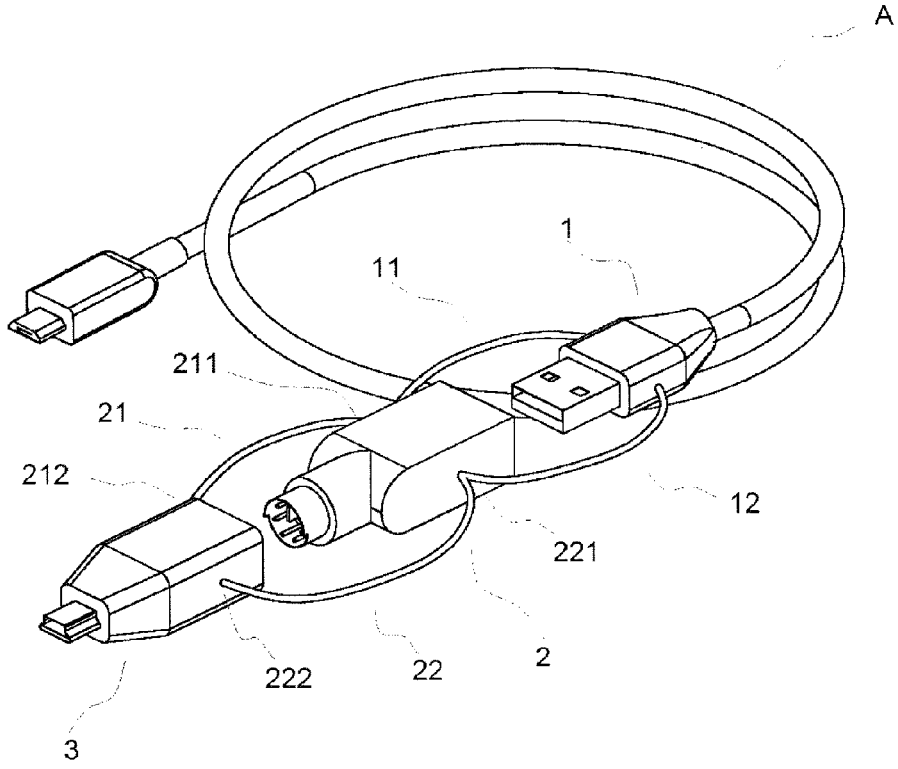
FIG. 4 is a schematic view showing three linking transfer plugs of the present invention.

Referring to FIG. 4, a third plug 3 is arranged to the transfer plug assembly. The two lateral sides of the second plug 2 are connected by first ends 211 and 221 of a third flexible link 21 and a fourth flexible link 22 respectively. Second ends 212 and 222 of the third flexible link 21 and fourth flexible link 22 are connected to two lateral sides of the third plug 3 respectively.

Figure 5:
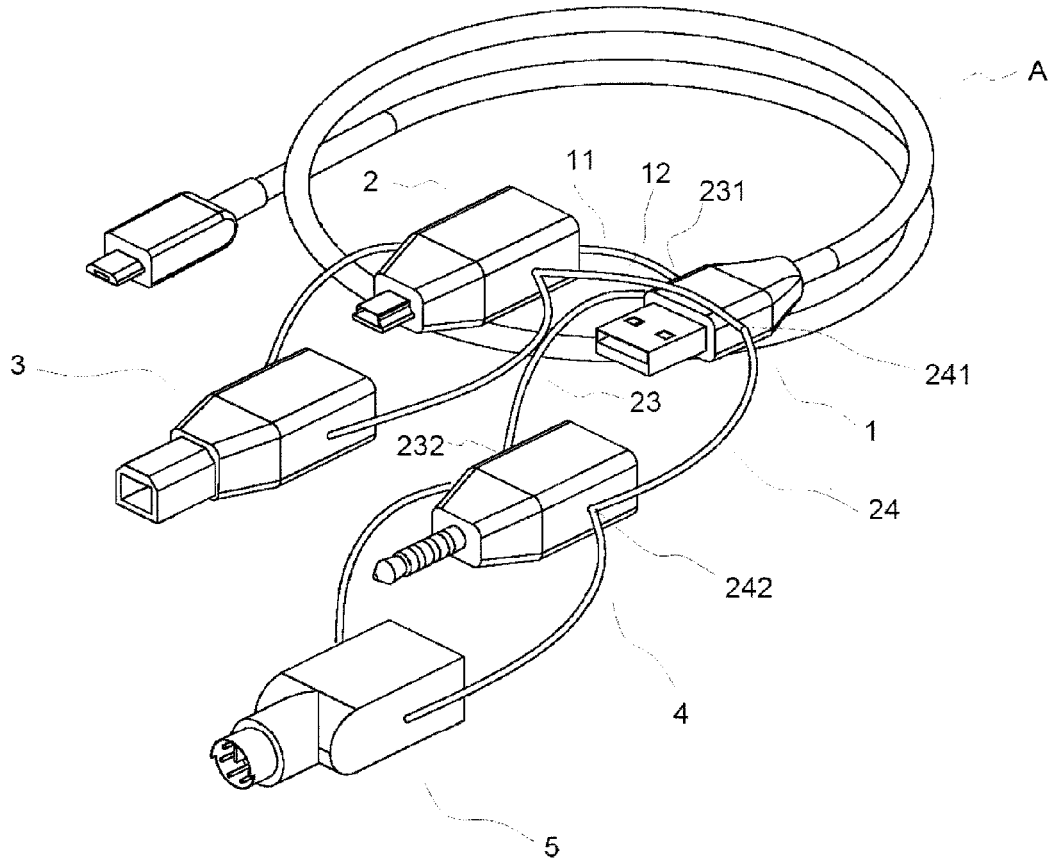
FIG. 5 is a schematic view showing two serial links of plug of the present invention.
Figure 6:
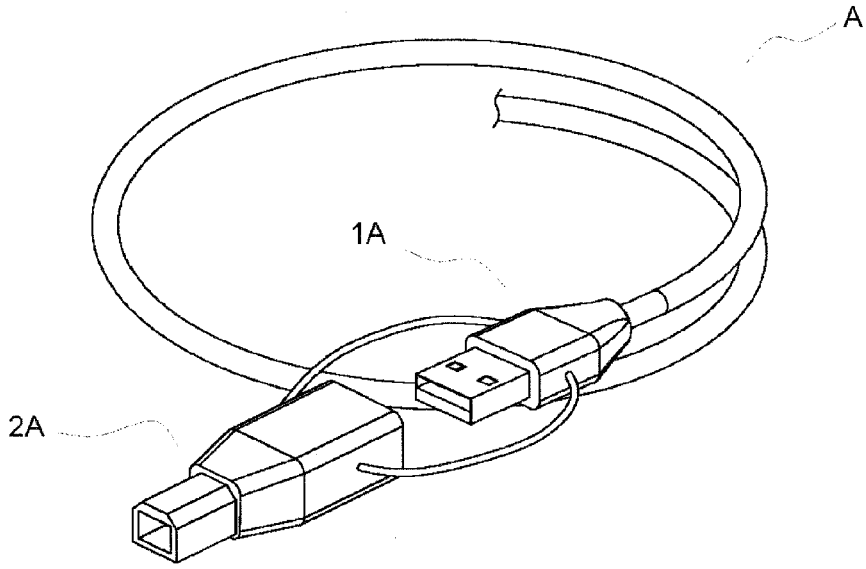
FIG. 6 is a schematic view showing separated first plug and second plug of specific sockets.
Figure 7:
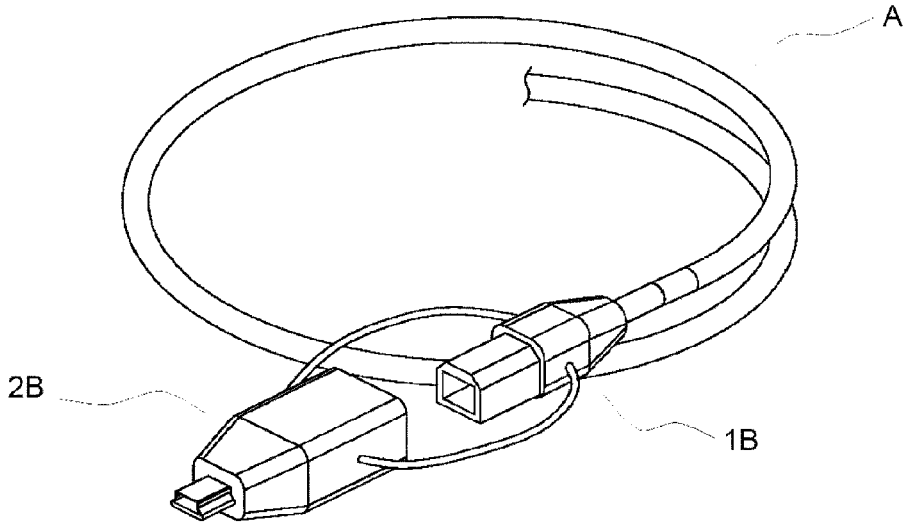
FIG. 7 is a schematic view showing separated first plug and second plug of specific sockets.
Figure 8:
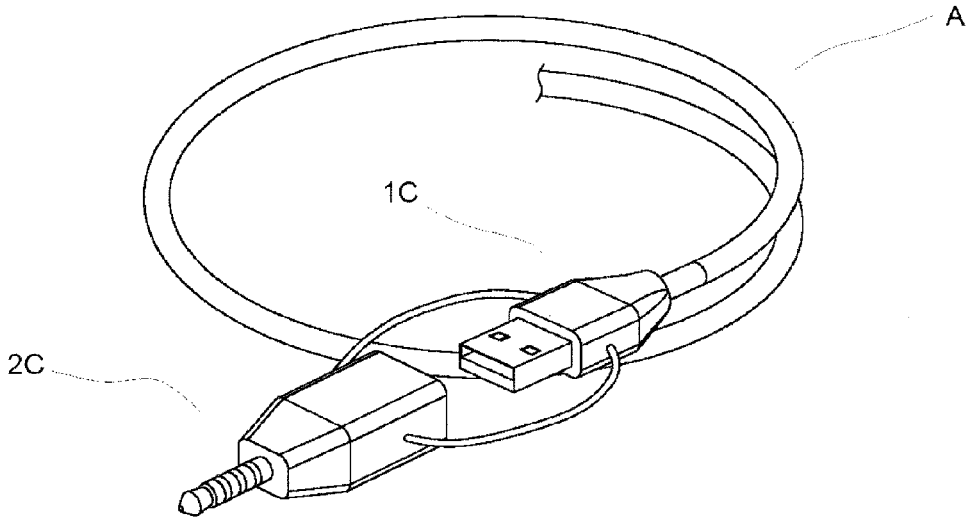
FIG. 8 is a schematic view showing separated first plug and second plug of specific sockets.
Figure 9:
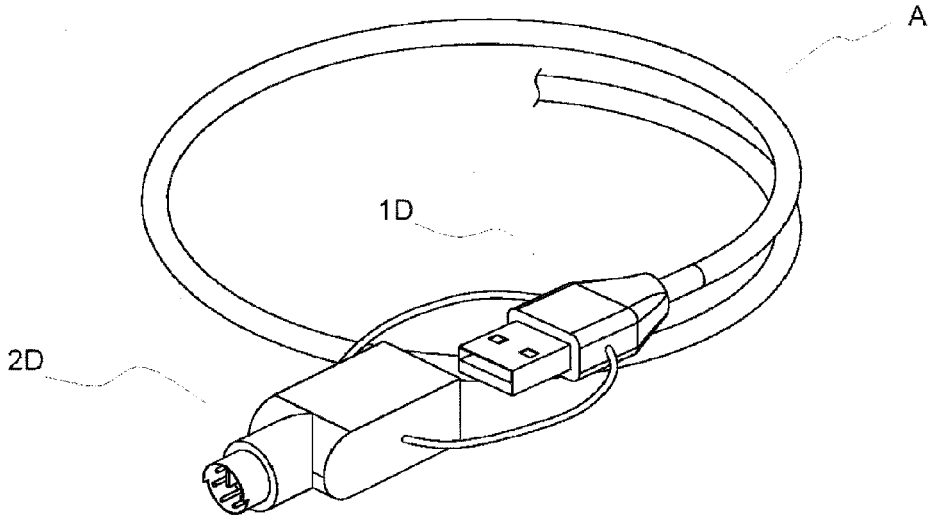
FIG. 9 is a schematic view showing separated first plug and second plug of specific sockets.
Figure 10:
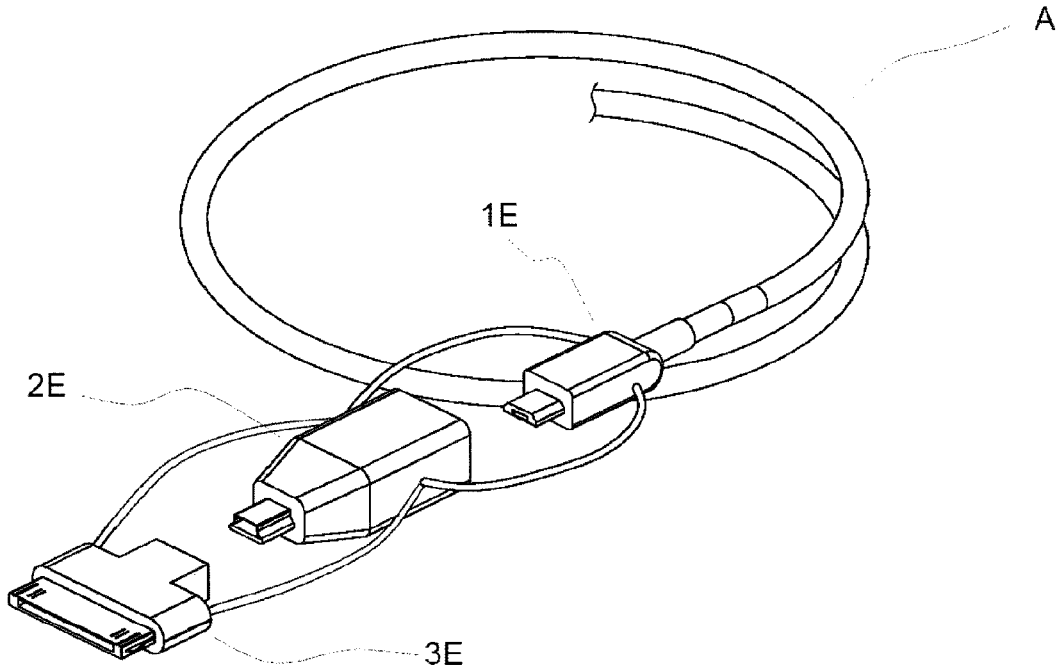
FIG. 10 is a schematic view showing separated first plug and second plug of specific sockets.

Referring to FIG. 5, the two lateral sides of the first plug 1 are further connected by first ends 231 and 241 of a fifth flexible link 23 and a sixth flexible link 24 respectively. Second ends 232 and 242 of the fifth flexible link 23 and a sixth flexible link 24 are connected to two lateral sides of a fourth plug 4 respectively. A fifth plug 5 is further linked to the fourth plug 4 by the same way as shown in FIG. 5.

Referring to FIGS. 6 to 10, embodiments having first plugs 1A, 1B, 1C, 1D, 1E, second plugs 2A, 2B, 2C, 2D, 2E, and third plug 3E of different sockets and specifications are shown.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A transfer plug assembly comprising:

a first plug having two lateral sides; the two lateral sides of the first plug being connected by a first end of a first flexible wire link and a first end of a second flexible wire link respectively;

a second plug having two lateral sides; the two lateral sides of the second plug being connected by a second end of the first flexible wire link and a second end of the second flexible wire link respectively.

2. The transfer plug as claimed in claim 1, further comprising a third plug having two lateral sides, a first end of the third flexible wire link and a first end of a fourth flexible wire link being connected to the two lateral sides of the second plug; a second end of the third flexible wire link and a second end of the fourth flexible wire link being connected to the two lateral sides of the third plug.

3. The transfer plug as claimed in claim 1, wherein a first end of a fifth flexible wire link and a first end of a sixth flexible wire link are connected to the two lateral sides of the first plug; two lateral sides of a fourth plug are connected to a second end of the fifth flexible wire link and a second end of the sixth flexible wire link respectively.

* * * * *